United States Patent [19]

Tanaka

[11] 4,281,406

[45] Jul. 28, 1981

[54] WATER-PROOF CASE FOR DIGITAL ELECTRONIC TIMEPIECES

[75] Inventor: Eiichiro Tanaka, Tokorozawa, Japan

[73] Assignee: Citizen Watch Co., Ltd., Tokyo, Japan

[21] Appl. No.: 92,932

[22] Filed: Nov. 9, 1979

[30] Foreign Application Priority Data

Nov. 22, 1978 [JP] Japan ..... 53-144784

[51] Int. Cl.[3] ..... G04C 19/00; G04C 23/02; G04B 37/00

[52] U.S. Cl. ..... 368/82; 368/88; 368/300

[58] Field of Search ..... 58/23 R, 50 R, 88 R, 58/127 R; 368/82–84, 88, 239–242, 276, 281, 286, 289, 291–292, 297–300, 309

[56] References Cited

U.S. PATENT DOCUMENTS

| | | | |
|---|---|---|---|
| 3,355,875 | 12/1967 | Jeanmonod et al. | 58/50 R |
| 3,672,155 | 6/1972 | Berget | 58/50 R |
| 3,729,924 | 5/1973 | Aoki | 368/291 |
| 3,910,029 | 10/1975 | Yamazaki | 58/50 R |
| 3,910,031 | 10/1975 | Keida | 368/281 |
| 3,945,195 | 3/1976 | Mason | 58/50 R |
| 3,978,653 | 9/1976 | Burke et al. | 58/23 R |
| 4,020,627 | 5/1977 | Yoshida et al. | 58/50 R |
| 4,086,954 | 5/1978 | Yonekawa et al. | 58/50 R |

*Primary Examiner*—Vit W. Miska

*Attorney, Agent, or Firm*—Sherman & Shalloway

[57] ABSTRACT

The invention relates to a thin water-proof timepiece case designed for digital electronic timepieces which employ panel-type display device such as liquid crystal display device. A glass cover, a panel cover which conceals the periphery of the display panel, and a coupling member for anchoring the screw on the back surface of the panel cover, are formed as a unitary structure. The glass cover and the case are water-tightly coupled together by the coupling member and a screw member which penetrates through the case.

9 Claims, 8 Drawing Figures

WATER-PROOF CASE FOR DIGITAL ELECTRONIC TIMEPIECES

BACKGROUND OF THE INVENTION

This invention relates to a water-proof case for digital electronic timepieces.

Timepiece cases have so far been composed of a case body, a back cover, a glass cover and a bezel ring. Such general timepiece cases have been designed mainly for analog timepieces which display the time by means of indicating hands. In the analog timepieces, the whole areas covered with the glass cover serve as a display portion, and the glass cover must be secured at the edge portion thereof using a bezel.

The conventional timepiece cases employing bezel do not necessarily adapt well to the timepieces which digitally display the time using a panel-type display device such as liquid crystal display device.

On the periphery of the panel-type display device are located a member for electrical connection and a member for fastening the panel, which do not directly participate in the function of display. To conceal such members, therefore, a panel cover must be employed. Consequently, with digital timepieces using such a display device, the entire area covered by the glass cover does not serve as a display portion, visibility is restricted by the panel cover and only the central area serves as a display portion.

Further, a panel-type display device, especially the liquid crystal display device, consists of many plate-like members. Hence, the light is reflected at the interfaces of the plate-like members, making it difficult to recognize the display.

Thus, since the analog timepieces are different in nature from digital timepieces, it is urged to provide a thin water-proof case adapted to the digital timepieces. This invention is attained based upon the above-mentioned background.

SUMMARY OF THE INVENTION

Accordingly, the object of this invention is to provide a thin water-proof case of a simple construction which is adapted to digital timepieces.

Another object of this invention is to provide a water-proof case for digital timepieces which permits the display panel to be easily replaced.

A further object of this invention is to provide a digital timepiece having a legible display portion with less interfacial reflection.

The invention relates to a timepiece case of a construction which is altogether different from that of the conventional timepiece case, and provides a thin water-proof case adapted to digital timepieces employing panel-type display device. According to the invention, a glass cover and a panel cover for concealing the periphery of the display panel, and a coupling member for anchoring the screw on the back surface of the panel cover are constructed as a unitary structure, wherein the glass cover and the case are coupled together in a water-tight manner by means of the coupling member and the screw which penetrates through the case.

DESCRIPTION OF THE PREFERRED EMBODIMENTS

Figure 1:
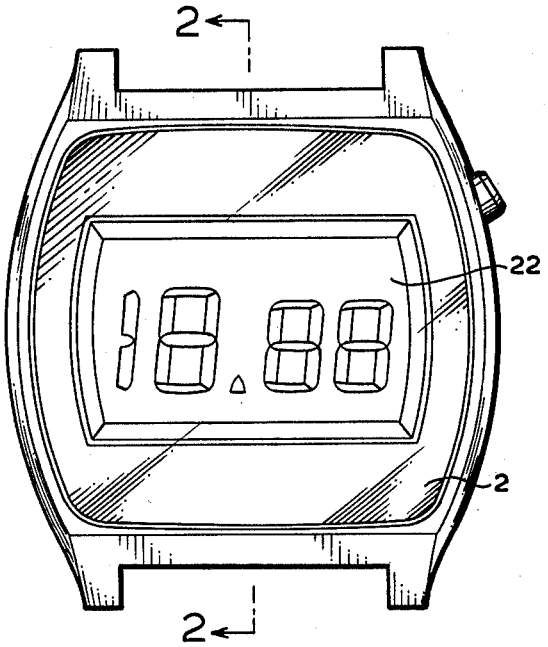
FIG. 1 is a front view illustrating a timepiece case according to an embodiment of this invention.

Embodiments of the invention are illustrated below in conjunction with the accompanying drawings. FIG. 1 is a front view illustrating a timepiece case according to this invention, in which the areas covered with a glass cover are limited by a panel cover 2, so that only the central portions serve as a display portion 22.

Figure 2:
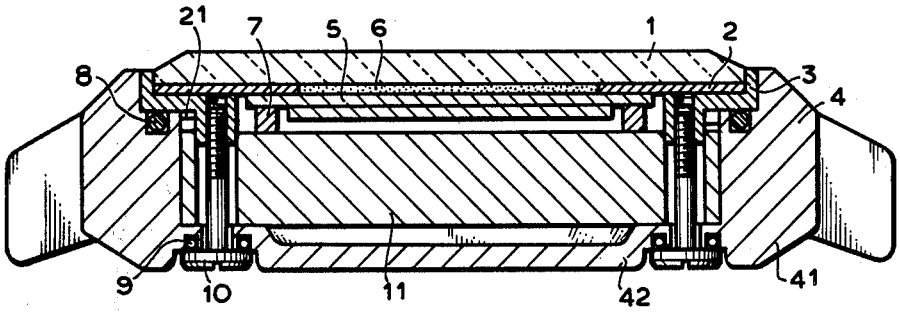
FIG. 2 is a cross-sectional view along the line 2—2 of FIG. 1.

FIG. 2 is a cross-sectional view illustrating the construction of the invention. First, the whole construction is mentioned below. A cover plate 1 is made of a transparent glass or a plastic material with a panel cover 2 being disposed on the back surface thereof. The panel cover 2 will consist of a metal layer or a resin layer and will be directly formed on the back surface of the cover plate by metal vaporization or coating. Alternatively, the panel cover 2 will be constructed as a separate unit and will then be attached to the back surface of the cover plate 1. A coupling member 3 is located on the back side of the panel cover 2. The coupling member 3 is made of a metal such as stainless steel or of a plastic material, and has screw holes in foot portions thereof. The number of the holes is preferably four, but may be suitably decreased or increased. The cover plate 1, the panel cover 2 and the coupling member 3 are then constructed as a unitary structure by way of adhesion, insertion by compression crimping or caulking. A digital display panel 5 is affixed to the central portion at the back surface of the cover plate 1, the adhering surface extending up to the back side of the panel cover 2. Needless to say, an adhesive layer 6 used to adhere the digital display panel 5 to the cover plate 1 should be transparent and should have a reflective index which is equal to or nearly equal to that of the cover plate 1 and the digital display panel 5, in order to prevent the reflection of light on the surface. The digital display panel 5 mentioned here refers to a liquid crystal display. However, other types of displays having nearly the same panel shape may be used, such as electrochromic display. An electrically conductive elastomeric connector 7 serves as a connector for supplying electric power to the digital display panel 5. The connector 7 is usually secured to the side of a movement 11 and is separated on a plane for drawing the electrodes of the digital display panel 5. The connector 7 maintains the electrically conductive state owing to the contacting pressure.

The case 4 usually consists of a case body 41 and a back cover 42. According to this invention, however, since the cover plate 1 is removeably attached, the movement 11 and other components can be mounted from that side occupied by the cover plate 1. There is no need for separately forming the case body and the back cover. In other words, the case can be formed of a one-piece construction. This enables the construction to be simplified and provides an increased mechanical strength even when the thickness of the case 4 is reduced. Details of the construction of the case 4 are mentioned below. In the front surface of the case 4 is formed a fitting groove which fits to the outer shape of the coupling member 3, and a packing 8 is placed on a shoulder portion of the fitting groove. A plurality of holes for penetrating screws 10 are formed in the bottom of the case 4. The head portion of the screws 10 is recessed into the hole so as not to protrude beyond the lower surface of the case 4. A packing 9 is placed on the fitting surface of the head portion of the screws 10 and is compressed by the back surface of the head of the screws 10 to attain sealing. The coupling member 3 is secured to the case 4 being pulled by the screws 10 which penetrate through the case 4, whereby the sealing is attained by the packings 8 and 9 which are compressed. The movement 11 is secured onto the bottom surface of the case 4 being pressed by springs 21. In addition to the above-mentioned fastening method, the movement may be directly secured to the case 4 by screws, by means of a fastening ring or by way of contacting frictional force.

Figure 3:
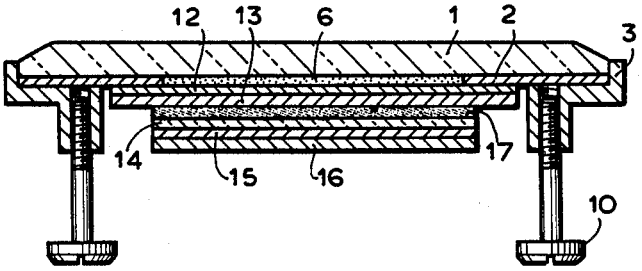
FIGS. 3 to 8 are cross-sectional views illustrating important portions of the timepiece case of the invention according to various other modified embodiments.

FIG. 3 is a cross-sectional view illustrating major portions of the invention, in which the cover plate 1, the panel cover 2 and the coupling member 3 are formed as a unitary structure as mentioned earlier. A digital display panel adhered to the back surfaces of the cover plate 1 and of the panel cover 2 is a FETN (field effect twisted nematic)-type liquid crystal display panel which is composed of an upper polarizer plate 12, an upper substrate glass 13, a liquid crystal layer 17, a lower substrate glass 14, a lower polarizer plate 15 and a reflecting plate 16. Using present technology, the total thickness of the FETN-type liquid crystal display panel can be reduced to 0.6 mm or less. Therefore, adhering the liquid crystal display panel to the cover plate 1 is advantageous from the standpoint of reinforcing the strength. With the above-mentioned construction, the distance in height between the surface of the panel cover 2 and the surface of the dial is about 0.3 mm, which can virtually be seen as flush by the naked eye, enabling a particular display to be presented. The above feature is possible because of the construction which permits the cover plate 1 to be detachably attached. With the conventional construction in which the cover plate and the case are formed as a unitary structure, the liquid crystal display panel cannot be adhered to the cover plate because such a construction does not permit repair or replacement to be effected.

Figure 4:
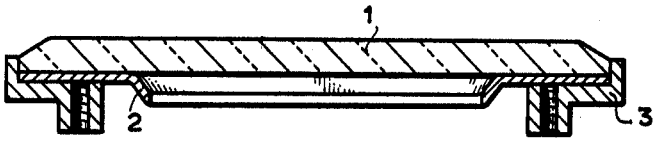

FIG. 4 illustrates the construction of FIG. 3 but from which the digital display panel is removed; the digital display panel is secured onto the movement 11 which is shown in FIG. 2. In the embodiment of FIG. 4, the cover plate 1, the panel cover 2 and the coupling member 3 are formed as a unitary structure like the previously-mentioned embodiment. However in this embodiment these three members can be replaced as a unitary structure to easily modify the appearance. This is advantageous from the standpoint of mass production. Although the coupling member 3 shown in FIG. 4 has screw holes, threaded feet penetrating through the bottom of the case may be attached to the coupling member 3 being fastened with nuts from the lower surface of the case.

Figure 5:
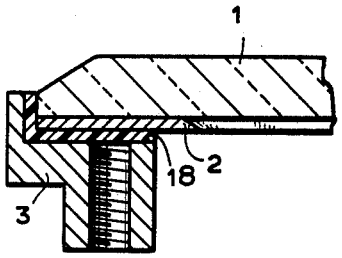
Figure 6:
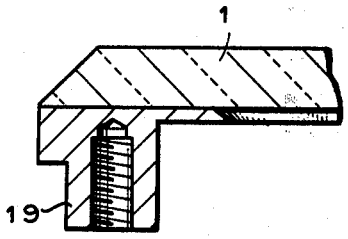

The invention is mentioned below with reference to FIGS. 5 and 6, which illustrate the methods of coupling the cover plate 1 and the coupling member 3 together. FIG. 5 illustrates the case in which the cover plate 1 and the coupling member 3 are coupled together using an adhesive 18 which is composed of a resin such as epoxy resin or those of the hot-melting type. The panel cover 2 which is formed by metal vaporization on the back surface of the cover plate 1 leaves no problem with respect to the adhesive strength. In this case, the coupling member 3 may also be adhered by solder. On the other hand, when the panel cover 2 of a resin layer is formed by printing on the back surface of the cover plate 1, it is necessary to use an ink which adheres to the cover plate 1. When the panel cover 2 is formed as a single unit, an adhesive of the type of epoxy resin or of the type which undergoes the hardening with the irradiation of ultraviolet rays should be used. FIG. 6 shows the case in which the panel cover and the coupling member are formed as a unitary structure 19. In this case, the surface of adhesion serves as a portion of interface between the cover plate 1 and the panel cover, enabling the working efficiency and the reliability of adhesion to be enhanced.

Figure 7:
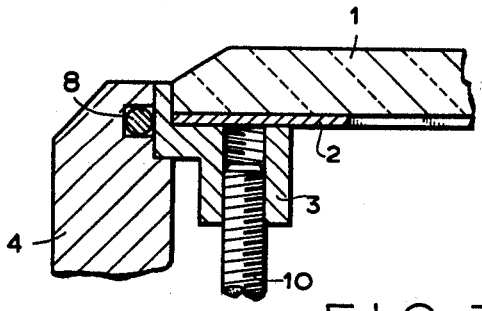
Figure 8:
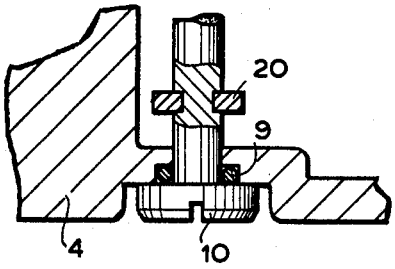

FIG. 7 shows the position of the packing 8 used for attaining the sealing between the case 4 and the coupling member 3. In this case, the deforming force of the packing 8 is exerted in the radial direction of the case 4, which does not work to push the cover plate 1 open. From the viewpoint of design, therefore, the construction of FIG. 7 may be more desirable than that of FIG. 2. Further, it is also allowable to form a groove (not shown) for accepting the packing 8 on the side of the coupling member 3. FIG. 8 shows an arrangement in which a stop ring 20 is fitted to the screw 10 so that it will not be removed and lost. From the standpoint of machinability of the groove, the packing 9 has a shape different from that of the embodiment of FIG. 2.

While the contents of the invention are as mentioned above, the greatest feature of the invention resides in that the cover plate which can be easily attached and detached by a screw driver. Owing to this feature, the timepiece case of this invention can be of a fashionable nature. In effect, the digital display panel, the panel cover and the cover plate can be treated as a unitary structure making it possible to change the color tone and to select the display functions or, in other words, making it possible to replace the panel with the one which displays the hour and minute in large characters, or to replace the panel with the one which displays the hour, minute, second, date and day. It will further be easily recognized that the above-mentioned unitary structure can be replaced even by unskilled people without permitting fingerprints to be left on the display surface. Further, since the aforementioned three members are replaced as a unitary structure, there develops no design unbalance between the display panel and the panel cover.

The advent of this invention having the above-mentioned various features is based upon such a background that the digital wrist watches necessarily require a panel cover at the back of the cover plate due to their structure. Namely, this invention stems from the fact that the appearance is not at all affected even if the back surface of the panel cover is used as a coupling element. The above construction could not be realized with the conventional analog timepieces. It is therefore proper to say that the case construction for digital wrist watches of this invention is the one which utilizes those characteristics inherent in digital watches.

What is claimed is:

1. A water-proof case for use in digital display timepieces comprising:

(a) a cover plate;

(b) a panel cover coupled with the back surface of the cover plate;

(c) a display panel arranged on the back side of the panel cover and the periphery of said display panel being concealed by said panel cover;

(d) a coupling member attached to the back surface of said panel cover as a unitary structure and having at least one hole therein, the hole being adapted to grip a fastener;

(e) a case body and a back cover being of a one-piece construction formed as a unitary structure;

(f) an aperture in said back cover corresponding to each of said holes in the coupling member, each aperture being coaxially positioned with each hole;

(g) each aperture being provided with a fastener, the fastener penetrating the back cover through one of said apertures and being gripped by the corresponding hole in the coupling member.

2. A water-proof case for digital timepieces as set forth in claim 1, wherein said panel display device is a liquid crystal display device of the FETN type (field effect twisted nematic type), and is adhered onto the lower surface of said glass cover.

3. A water-proof case for digital timepieces as set forth in claim 1, wherein said panel cover consists of an opaque film which is printed or vaporized onto the back surface of said glass cover.

4. A water-proof case for digital timepieces as set forth in claim 1, wherein said panel cover is made of a thin metallic plate and is adhered onto the back surface of said panel cover.

5. A water-proof case for digital timepieces as set forth in claim 1, wherein a portion defining a display portion of said panel cover is a peripheral edge which is tilted toward the inner side, and said panel cover is adhered onto the back surface of said panel cover.

6. A water-proof case for digital timepieces as set forth in claim 1, wherein an upper portion of said coupling member serves as a panel cover.

7. A water-proof case for digital timepieces as set forth in claim 1, further comprising a packing accommodated in a groove which is formed in the inner side of said case.

8. A water-proof case for use in digital timepieces wherein said fasteners are screws.

9. A water-proof case for digital timepieces as set forth in claim 8, further comprising a stop ring fitted to said coupling screws.

* * * * *

UNITED STATES PATENT AND TRADEMARK OFFICE

CERTIFICATE OF CORRECTION

PATENT NO. : 4,281,406

DATED : July 28, 1981

INVENTOR(S) : Tanaka, Eiichiro

It is certified that error appears in the above—identified patent and that said Letters Patent is hereby corrected as shown below:

Claim 8 should read as follows:

8. A water-proof case for use in digital timepieces as set forth in claim 1 wherein said fasteners are screws.

Signed and Sealed this

*Twenty-second* Day of *September 1981*

[SEAL]

*Attest:*

GERALD J. MOSSINGHOFF

*Attesting Officer*

*Commissioner of Patents and Trademarks*